US011511966B2

(12) United States Patent
Miyazaki

(10) Patent No.: US 11,511,966 B2
(45) Date of Patent: Nov. 29, 2022

(54) DERAILMENT DETECTION DEVICE FOR A COUNTERWEIGHT OF AN ELEVATOR

(71) Applicant: Mitsubishi Electric Corporation, Tokyo (JP)

(72) Inventor: Yoshiko Miyazaki, Tokyo (JP)

(73) Assignee: MITSUBISHI ELECTRIC CORPORATION, Tokyo (JP)

( * ) Notice: Subject to any disclaimer, the term of this patent is extended or adjusted under 35 U.S.C. 154(b) by 560 days.

(21) Appl. No.: 16/487,095

(22) PCT Filed: Apr. 26, 2017

(86) PCT No.: PCT/JP2017/016606
§ 371 (c)(1),
(2) Date: Aug. 20, 2019

(87) PCT Pub. No.: WO2018/198243
PCT Pub. Date: Nov. 1, 2018

(65) Prior Publication Data
US 2021/0130128 A1 May 6, 2021

(51) Int. Cl.
*B66B 5/12* (2006.01)
*B66B 7/02* (2006.01)

(52) U.S. Cl.
CPC ..... *B66B 5/125* (2013.01); *B66B 7/02* (2013.01)

(58) Field of Classification Search
CPC ..... B66B 5/125; B66B 7/02; B66B 5/0031
See application file for complete search history.

(56) References Cited

U.S. PATENT DOCUMENTS 4,643,276 A * 2/1987 Philobos ..... B66B 5/022 187/278
2012/0097487 A1* 4/2012 Winey ..... B66B 5/021 187/393

FOREIGN PATENT DOCUMENTS

| | | | |
|---|---|---|---|
| JP | 53-59278 | U | 5/1978 |
| JP | 63-42678 | U | 3/1988 |
| JP | 7-149482 | A | 6/1995 |
| JP | 9-255252 | A | 9/1997 |
| JP | 2012-533496 | A | 12/2012 |
| WO | 2011/010376 | A1 | 1/2011 |

OTHER PUBLICATIONS

International Search Report and Written Opinion dated Jul. 18, 2017 for PCT/JP2017/016606 filed on Apr. 26, 2017, 9 pages including English Translation of the International Search Report.

* cited by examiner

*Primary Examiner* — Jeffrey Donels
(74) *Attorney, Agent, or Firm* — Xsensus LLP

(57) ABSTRACT

Provided is a derailment detection device for a counterweight of an elevator comprising: a wire suspended in parallel with a guide rail for the counterweight; a cylindrical member which has an arm portion connected to the counterweight and allows the wire to pass therethrough in a vertical direction; a detection target connected to a lower end of the wire; a photoelectric sensor which is provided on a fixed surface so as to be opposed to a lower surface of the detection target and measures a distance to the detection target; and a detection circuit electrically connected to the photoelectric sensor. The detection circuit detects that the counterweight runs off the guide rail based on the distance from the photoelectric sensor to the detection target.

9 Claims, 2 Drawing Sheets

DERAILMENT DETECTION DEVICE FOR A COUNTERWEIGHT OF AN ELEVATOR

CROSS-REFERENCE TO RELATED APPLICATION

The present application is based on PCT filing PCT/JP2017/016606, filed Apr. 26, 2017, the entire contents of which are incorporated herein by reference.

TECHNICAL FIELD

The present invention relates to a device which detects that a counterweight of an elevator runs off guide rails, for example, due to earthquake.

BACKGROUND ART

As a related-art derailment detection device for a counterweight of an elevator, there has been known a derailment detection device having the following configuration (for example, Patent Literature 1). Specifically, a contactor is mounted to a counterweight, and a conductive wire is installed in parallel with guide rails in a hoistway. When the counterweight runs off the guide rails, the contactor is brought into contact with the conductive wire, and the derailment is detected. Moreover, there has also been known a derailment detection device having the following configuration (for example, Patent Literature 2). Specifically, a detector is installed on a guide shoe for a counterweight, and the derailment is detected in accordance with a state of contact with a rail surface. Then, the detection result is transferred through a trolley line installed along a rising/lowering course of the counterweight.

CITATION LIST

Patent Literature

[PTL 1] WO 2001/010376 A1
[PTL 2] JP 07-149482 A

SUMMARY OF INVENTION

Technical Problem

However, in the related arts described above, the derailment is detected through the conductive wire or the trolley wire provided in the hoistway. Therefore, there is a fear in that a maintenance worker touches the live line to cause an electric shock.

This invention has been made to solve such problem, and has an object to provide a detection device which is capable of safely detecting that a counterweight of an elevator runs off guide rails.

Solution to Problem

According to one embodiment of the present invention, there is provided a derailment detection device for a counterweight of an elevator comprising: a wire suspended in parallel with a guide rail for the counterweight; a cylindrical member which has an arm portion connected to the counterweight and allows the wire to pass therethrough in a vertical direction; a detection target connected to a lower end of the wire; a photoelectric sensor which is provided on a fixed surface so as to be opposed to a lower surface of the detection target and measures a distance to the detection target; and a detection circuit electrically connected to the photoelectric sensor, wherein the detection circuit detects that the counterweight runs off the guide rail based on the distance from the photoelectric sensor to the detection target.

Advantageous Effects of Invention

The derailment detection device for a counterweight of an elevator according to the present invention is capable of safely detecting that the counterweight of the elevator runs off the guide rails.

DESCRIPTION OF EMBODIMENTS

Figure 1:
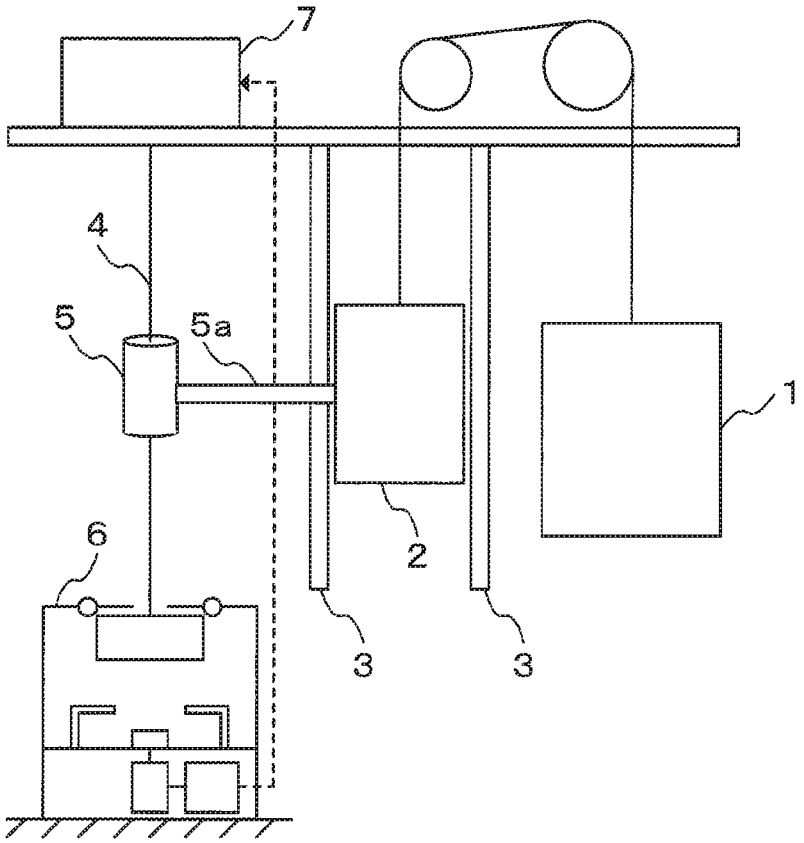
FIG. 1 is a view for illustrating a derailment detection device for a counterweight of an elevator according to an embodiment of the present invention.

Now, with reference to accompanying FIG. 1 to FIG. 4, detailed description is made of an embodiment of the present invention. The embodiment described below is one example, and the present invention is not limited to this embodiment. Moreover, in FIG. 1 and FIG. 2, an upward direction on the drawing sheet corresponds to an upward direction, and a downward direction on the drawing sheet corresponds to a downward direction. Further, the gravity applies in the vertically downward direction.

Embodiment

FIG. 1 is a schematic view for illustrating a derailment detection device for a counterweight of an elevator according to an embodiment of the present invention.

The derailment detection device for a counterweight of an elevator detects that a counterweight 2, which is balanced with a weight of a car 1 of an elevator, runs off guide rails 3 configured to guide movement of the counterweight 2 in a hoistway in a vertical direction.

The detection device comprises a wire 4, a cylindrical member 5, and a detector 6. The wire 4 is suspended in parallel with the guide rails 3 from an upper part of the hoistway. The cylindrical member 5 has an arm portion 5*a* connected to the counterweight 2. The cylindrical member 5 allows the wire 4 to pass therethrough in the vertical direction. The detector 6 is connected to a lower end of the wire 4. The detector 6 is electrically connected to an elevator control board 7 which controls an operation of the elevator.

Figure 2:
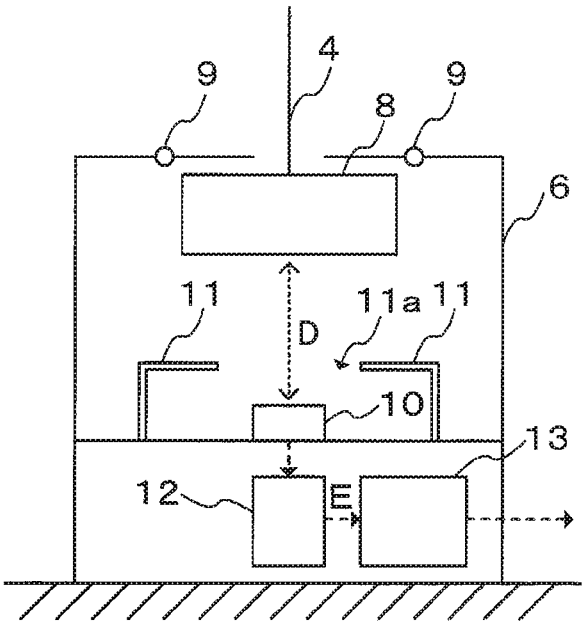
FIG. 2 is a view for illustrating a configuration of a detector in the detection device according to the embodiment.

FIG. 2 is a view for illustrating a configuration of the detector 6. The detector 6 comprises a detection target 8 hinges 9, a photoelectric sensor 10, a protection member 11, a detection circuit 12, and a cut-off circuit 13.

The detection target 8 is mounted to a lower end of the wire 4. The detection target 8 is made of a material such as iron.

The hinges 9 are configured to restrict vertically upward movement of the detection target 8. Also, the hinges 9 are configured to open upward when a force of a certain amount or more is applied from the detection target 8.

The photoelectric sensor 10 is provided on a fixed surface so that it is opposed to a lower surface of the detection target 8. The photoelectric sensor 10 measures a distance D to the detection target 8 and outputs a measurement result to the detection circuit 12. The distance D from the photoelectric sensor 10 to the detection target 8 is, for example, 0.5 m.

The protection member 11 is configured to protect the photoelectric sensor 10 when the detection target 8 falls due to breakage of the wire 4. The protection member 11 is provided between the photoelectric sensor 10 and the detection target 8. The protection member 11 has, on an upper surface thereof, an opening 11*a* which is smaller than the lower surface of the detection target 8. Instead of forming the opening 11*a* on the upper surface of the protection member 11, the upper surface of the protection member 11 may be made of a material which allows the passage of a signal radiated from the photoelectric sensor 10.

If it is detected that the distance from the photoelectric sensor 10 to the detection target 8 is more than a predetermined value D1 (for example, 1.0 m), and if it is detected that the distance from the photoelectric sensor 10 to the detection target 8 is less than a predetermined value D2 (for example, 0.1 m), the detection circuit 12 outputs a predetermined abnormality signal E to the cut-off circuit 13.

When the abnormality signal E is received from the detection circuit 12, the cut-off circuit 13 cuts off the supply of power to an I/O board of the elevator control board 7.

Figure 3:
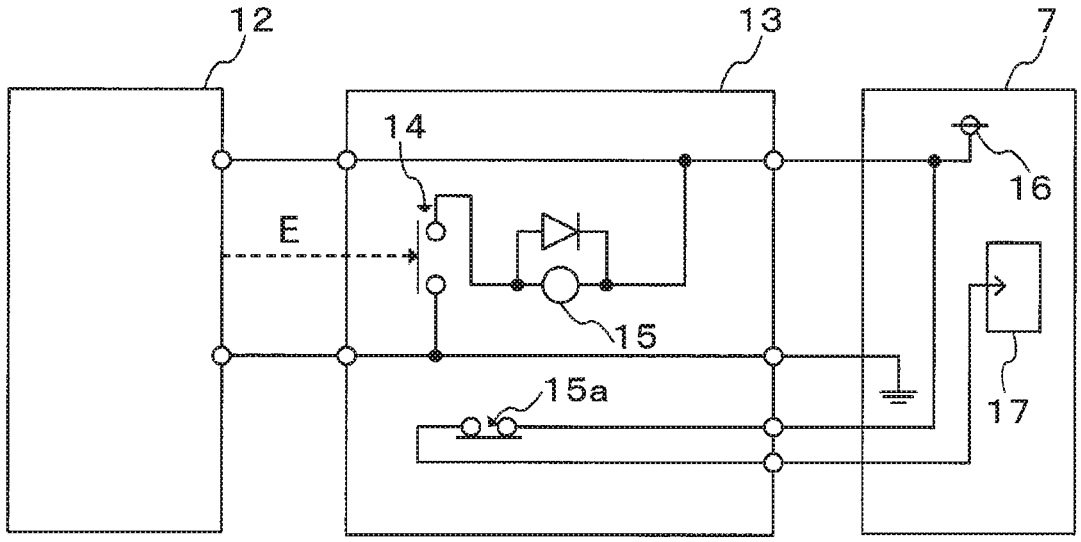
FIG. 3 is a diagram for illustrating details of an cut-off circuit in the detection device according to the embodiment.

FIG. 3 is a detailed illustration of the cut-off circuit 13. In the cut-off circuit 13, when the abnormality signal E is received from the detection circuit 12, a switch 14 is turned on. Then, a power voltage 16 is applied to a relay 15 to cause a flow of a current, and a relay contact 15*a* of a normally closed type opens. When the relay contact 15*a* opens, the supply of power to the I/O board 17 provided in the elevator control board 7 is cut off. With this, the elevator is stopped, and restart is prohibited.

Figure 4:
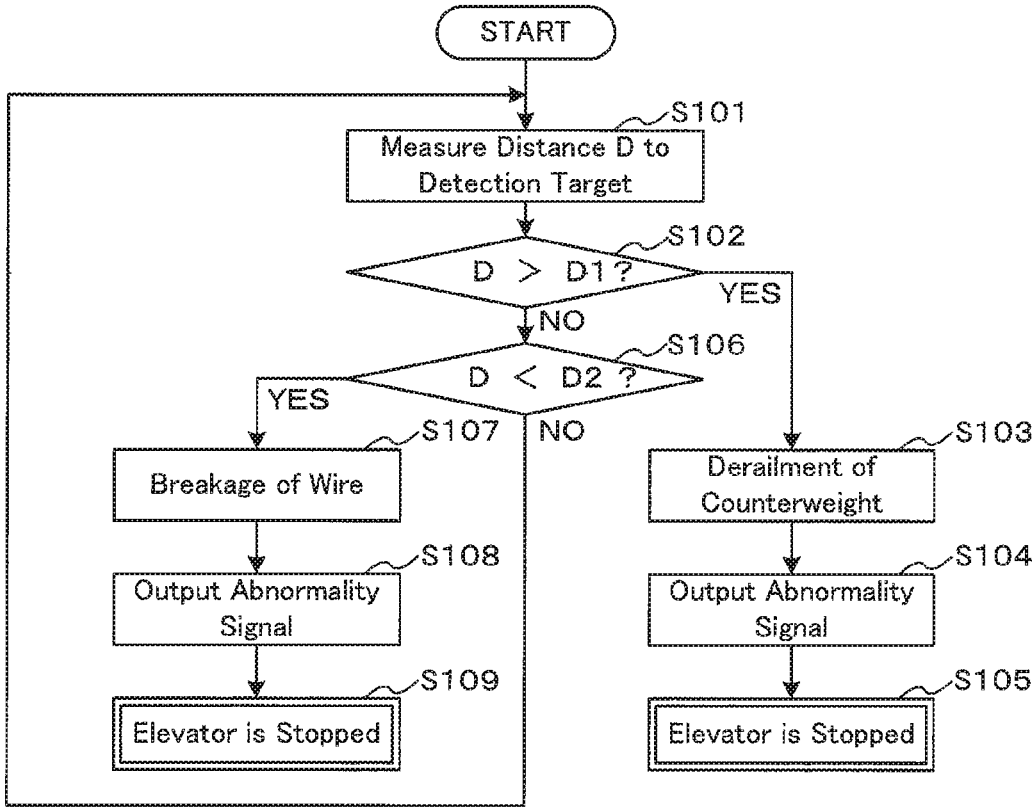
FIG. 4 is an explanatory flowchart for illustrating an operation of the detection device according to the embodiment.

Next, with reference to a flowchart of FIG. 4, an operation of the derailment detection device for the counterweight of the elevator according to the embodiment of the present invention is described.

In a normal state in which the derailment of the counterweight 2 and the breakage of the wire 4 do not occur, the distance D from the photoelectric sensor 10 to the detection target 8 is, for example, 0.5 m. The photoelectric sensor 10 always measures the distance to the detection target 8 and outputs the measurement result to the detection circuit (Step S101). If the distance D to the detection target 8 is equal to or less than the predetermined value D1 (Step S102=NO) and is equal to or more than the predetermined value D2 (Step S106=NO), the detection circuit 12 does not output the abnormality signal E. Therefore, the supply of power to the I/O board 17 of the elevator control board 7 is performed, and a normal operation of the elevator can be performed.

If the counterweight 2 runs off the guide rails 3, the wire 4 is pulled by the cylindrical member 5, and hence the detection target 8 moves upward. Accordingly, the distance from the photoelectric sensor 10 to the detection target 8 becomes longer than that given in the normal state. If it is detected that the distance D from the photoelectric sensor 10 to the detection target 8 is more than the predetermined value D1 (for example, 1.0 m) (Step S102=YES), the detection circuit 12 determines that the derailment of the counterweight 2 occurs (Step S103), and outputs the abnormality signal (Step S104). As a result, the cut-off circuit 13 is driven to cut off the supply of power to the I/O board 17 of the elevator control board 7, to thereby stop the elevator and prohibit restart of the elevator (Step S105).

Meanwhile, if the breakage of the wire 4 occurs, the detection target 8 falls, and hence the distance from the photoelectric sensor 10 to the detection target 8 becomes shorter than that given in the normal state. If it is detected that the distance D from the photoelectric sensor 10 to the detection target 8 is less than the predetermined value D2 (for example, 0.1 m) (Step S106=YES), the detection circuit 12 determines that the breakage of the wire 4 occurs (Step S107), and outputs the abnormality signal E (Step S108). As a result, similarly to the configuration described above, the cut-off circuit 13 is driven to stop the supply of power to the I/O board 17 of the elevator control board 7, to thereby stop the elevator and prohibit restart (Step S109).

As described above, the derailment detection device for the counterweight of the elevator comprises: the wire 4 suspended in parallel with the guide rail 3 for the counterweight 2; the cylindrical member 5 which has the arm portion 5*a* connected to the counterweight 2 and allows the wire 4 to pass therethrough in a vertical direction; the detection target 8 connected to a lower end of the wire 4; the photoelectric sensor 10 which is provided on the fixed surface so as to be opposed to the lower surface of the detection target 8 and measures the distance to the detection target 8; and the detection circuit 12 electrically connected to the photoelectric sensor 10.

When the distance from the photoelectric sensor 10 to the detection target 8 is more than the predetermined value D1, the detection circuit 12 detects that the counterweight 2 runs off the guide rails 3. With this configuration, there is no need to provide a conductive wire or a trolley wire in the hoistway, and hence a maintenance worker is prevented from touching the live wire to cause an electric shock. Moreover, in Patent Literature 1 described above, there is a problem in that the derailment cannot be detected when rust is formed on the conductive wire. However, in the case of the present invention, the derailment can be detected even when rust is formed on the wire 4.

Moreover, when the distance from the photoelectric sensor 10 to the detection target 8 is less than the predetermined value D2, the detection circuit 12 detects that the wire 4 is cut. With this configuration, the breakage of the wire 4, that is, a failure of the detection device itself can also be detected.

Moreover, when it is detected that the counterweight 2 runs off the guide rails 3, and when it is detected that the wire 4 is cut, the detection circuit 12 outputs the abnormality signal E to the cut-off circuit 13. The cut-off circuit 13 stops the supply of power to the I/O board 17 of the elevator control board 7, to thereby stop the elevator and prohibit restart. With this configuration, an elevator system including the detection device according to the present invention mounted thereto becomes a fail-safe system.

REFERENCE SIGNS LIST

1 car, 2 counterweight, 3 guide rails, 4 wire, 5 cylindrical member, 5*a* arm portion, 6 detector, 7 elevator control board, 8 detection target, 9 hinges, 10 photoelectric sensor, 11 protection member, 11*a* opening, 12 detection circuit, 13 cut-off circuit, 14 switch, 15 relay, 15*a* relay contact, 16 power voltage, 17 I/O board, E abnormality signal.

The invention claimed is:

1. A derailment detection device for a counterweight of an elevator, comprising:

a wire suspended in parallel with a guide rail for the counterweight;

a cylindrical member which has an arm portion connected to the counterweight and allows the wire to pass therethrough in a vertical direction;

a detection target connected to a lower end of the wire;

a photoelectric sensor which is provided on a fixed surface so as to be opposed to a lower surface of the detection target and measures a distance to the detection target; and a detection circuit electrically connected to the photoelectric sensor, wherein the detection circuit detects that the counterweight runs off the guide rail based on the distance from the photoelectric sensor to the detection target.

2. The derailment detection device for a counterweight of an elevator according to claim 1, wherein the detection circuit detects that the counterweight runs off the guide rail when the distance from the photoelectric sensor to the detection target is more than a first predetermined value.

3. The derailment detection device for a counterweight of an elevator according to claim 1, wherein the detection circuit detects that the wire is cut when the distance from the photoelectric sensor to the detection target is less than a second predetermined value.

4. The derailment detection device for a counterweight of an elevator according to claim 1, further comprising a cut-off circuit configured to cut off a supply of power to an I/O board of an elevator control board, wherein, when the detection circuit detects that the counterweight runs off the guide rail, the cut-off circuit stops the supply of power to the I/O board of the elevator control board, to thereby stop the elevator and prohibit restart.

5. The derailment detection device for a counterweight of an elevator according to claim 4, wherein, when the detection circuit detects that the wire is cut, the cut-off circuit stops the supply of power to the I/O board of the elevator control board, to thereby stop the elevator and prohibit restart.

6. The derailment detection device for a counterweight of an elevator according to claim 1, further comprising a protection member which is provided between the photoelectric sensor and the detection target and is configured to protect the photoelectric sensor from a falling of the detection target.

7. The derailment detection device for a counterweight of an elevator according to claim 6, wherein the protection member has an opening portion on an upper surface thereof, and the opening portion has a size smaller than a size of a lower surface of the detection target.

8. The derailment detection device for a counterweight of an elevator according to claim 6, wherein the protection member is made of a material configured to allow a passage of a signal radiated from the photoelectric sensor.

9. The derailment detection device for a counterweight of an elevator according to claim 1, further comprising a pair of hinges arranged between the detection target and the cylindrical member, and the hinges are configured to restrict vertically upward movement of the detection target and are configured to open when a force of a certain amount or more is applied from the detection target.

* * * * *